US005224779A

United States Patent [19]

Thompson et al.

[11] Patent Number: 5,224,779

[45] Date of Patent: Jul. 6, 1993

[54] TAMPER-EVIDENT, RECLOSABLE FLEXIBLE PACKAGES

[75] Inventors: Bjorn J. Thompson, Madison; Gerald O. Hustad, McFarland; Todd S. Marnocha, Sun Prairie, all of Wis.

[73] Assignee: Oscar Mayer Foods Corporation, Madison, Wis.

[21] Appl. No.: 855,155

[22] Filed: Mar. 20, 1992

Related U.S. Application Data

[62] Division of Ser. No. 659,207, Feb. 22, 1991, abandoned.

[30] Foreign Application Priority Data

Jan. 26, 1990 [CA] Canada ..... 2008736
Jan. 30, 1990 [CA] Canada ..... 90300969
Feb. 23, 1990 [JP] Japan ..... 2-44311

[51] Int. Cl.[5] ..... B65D 33/18; B65D 33/34

[52] U.S. Cl. ..... 383/5; 229/81; 383/61; 383/93; 383/209; 383/211

[58] Field of Search ..... 383/5, 207, 208, 209, 383/93, 61, 210, 211; 229/102, 81; 206/807; 426/129, 122

[56] References Cited

U.S. PATENT DOCUMENTS

| | | | |
|---|---|---|---|
| 2,833,461 | 5/1958 | Brom | 229/85 |
| 3,001,689 | 9/1961 | Burton | 383/93 |
| 3,073,507 | 1/1963 | Trewella et al. | 229/62 |
| 3,104,798 | 9/1963 | Stone | 383/93 |
| 3,119,549 | 1/1964 | Schoen | 229/63 |
| 3,172,443 | 3/1965 | Ausnit | 383/61 |
| 3,181,583 | 5/1965 | Lingenfelter | 150/3 |
| 3,226,787 | 1/1966 | Ausnit | 24/201 |
| 3,473,589 | 10/1969 | Gotz | 150/3 |
| 3,595,468 | 7/1971 | Repko | 229/66 |
| 3,780,781 | 12/1973 | Uramoto | 150/3 |
| 3,827,472 | 8/1974 | Uramoto | 150/3 |
| 4,015,771 | 4/1977 | Sengewald | 229/62 |
| 4,296,179 | 10/1981 | Wardwell | 428/498 |
| 4,574,951 | 3/1986 | Weaver | 206/461 |
| 4,589,145 | 5/1986 | Van Erden et al. | 383/5 |
| 4,653,113 | 3/1987 | Taylor | 206/807 |
| 4,709,396 | 11/1987 | Voshall et al. | 383/5 |
| 4,782,951 | 11/1988 | Griesbach et al. | 206/484 |
| 4,786,190 | 11/1988 | Van Erden et al. | 383/61 |
| 4,823,961 | 4/1989 | Griesbach et al. | 426/129 |
| 4,876,123 | 10/1989 | Rivera et al. | 229/102 |
| 4,966,470 | 10/1990 | Thompson et al. | 383/61 |
| 5,026,563 | 6/1991 | Van Erden et al. | 383/93 |

FOREIGN PATENT DOCUMENTS

| | | | |
|---|---|---|---|
| 276554 | 3/1988 | European Pat. Off. . | |
| 302144 | 8/1989 | European Pat. Off. . | |
| 385323 | 2/1990 | European Pat. Off. . | |
| 8712882 | 4/1987 | Fed. Rep. of Germany . | |
| 1323348 | 5/1962 | France . | |
| 1504276 | 12/1966 | France . | |
| 2543110 | 3/1983 | France . | |
| 1010738 | 5/1963 | United Kingdom . | |
| 2150908 | 7/1985 | United Kingdom | 383/209 |

*Primary Examiner*—Stephen P. Garbe
*Attorney, Agent, or Firm*—Lockwood, Alex, Fitzgibbon & Cummings

[57] ABSTRACT

A reclosable, hermetically-sealed flexible package which has an inner, hermetic peel seal and a reclosure seal comprised of interlocking closure strips is provided with a tamper-evident feature located peripheral to the reclosure seal. The tamper-evident feature must be visibly disrupted to gain access to the reclosure seal.

6 Claims, 3 Drawing Sheets

TAMPER-EVIDENT, RECLOSABLE FLEXIBLE PACKAGES

This application is a division of application Ser. No. 659,207, filed Feb. 22, 1991, now abandoned.

FIELD OF THE INVENTION

This invention relates to flexible, bag-like packages which are provided with an inner, hermetic peel seal and an outer reclosure seal, such as a zipper seal. These packages provide convenience to the consumer in that the contents of the package may be easily accessed by first opening the reclosure seal and then separating the hermetic peel seal. After removing a portion of the package contents, the package can be reclosed by means of the reclosure seal.

DESCRIPTION OF THE PRIOR ART

Flexible packages which have an inner, hermetic peelable seal and an outer zipper seal are presently known for packaging various food products, such as weiners, bacon, sliced luncheon meats, chops, cheese and the like. These packages, including the materials of construction, are fully described in U.S. Pat. No. 4,782,951 to Hustad and Griesbach which is hereby incorporated by reference. A common use of such packaging is to vacuum seal the food product between two sheets of film material to form a generally rectangular shaped package which is hermetically sealed (e.g., heat sealed) with a single, non-reclosable seal about three sides and which has an access opening at the fourth side which includes both a hermetic, non-reclosable seal and a reclosure seal.

When the access opening consists of an outer zipper reclosure seal and an inner, non-reclosable, peel seal, it has been found that the package may be opened and then reclosed without showing outwardly visible evidence of such openings. Thus, a package which has been opened and thereafter reclosed, but from which no contents have been removed, would have an outward appearance comparable to a package which retains its inner, hermetic peel seal. A consumer who purchases and thereafter opens a previously-opened package would, of course, especially for vacuum-packed products, be able to determine that the hermetic seal has been broken. Determining that a gas-flushed package had been previously opened might possibly be more difficult. It would, however, be preferred that it be readily apparent to the consumer in the store (i.e., before purchase) that the package had been previously opened.

Various techniques have been known for providing visual, tamper-evident features on flexible packages. U.S. Pat. No. 3,780,781 to Uramoto, U.S. Pat. No. 4,015,771 to Sengevald and U.S. Pat. No. 4,786,190 to Van Erden et al. are examples of such tamper-evident packages. Tamper-evident features have not, however, been previously used on flexible packages which have an inner, hermetic peel seal and an outer reclosable seal.

SUMMARY OF THE INVENTION

The packages of the present invention have a unique combination of features. The packages are in-store tamper-evident, such that it is apparent to the consumer that the package has been opened upon even casual examination of the package. The package has an intermediate reclosure seal which can be opened and reclosed a number of times in order to remove portions of the package contents. The reclosure seal forms a liquid-tight seal and the reclosure seal is not susceptible to interference by contact with fluids (e.g., water, juices, oils, etc.) which may be a component of the packaged product. A zipper seal consisting of interlocking closure strips is the preferred reclosure seal means.

Additionally, the package has a hermetic, inner seal which is an easy-open or peel seal. The peel seal is generally parallel to the reclosure seal and is opened with digital pull-apart forces which may be a continuation of the forces used to open the reclosable seal. The peel seal can maintain a vacuum, a pressurized and/or a modified gaseous environment within the flexible package. The peel seal will be formed by effecting a face-to-face seal between two plys of plastic film with the strength of the seal permitting separation without destruction or tearing of either ply. As described in the Hustad and Greisbach patent, the contacting surface of the two plys should be of dissimilar materials in order to produce the desired peel seal.

The package of this invention further includes an outer tamper-evident feature which must be disrupted in order to gain access to the intermediate reclosure seal. The disruption of the tamper-evident feature will provide visible evidence of the fact that entry to the contents of the bag, through the intermediate reclosure seal and the inner peel seal, may have occurred.

As with the package of the Hustad and Griesbach patent, the tamper-evident, reclosable and hermetically-sealed package of this invention may be made on a single machine using a straight-through process.

The features and objects of the present invention will be readily apparent from the following detailed description thereof taken in conjunction with the accompanying drawings.

BRIEF DESCRIPTION OF THE DRAWINGS

In the drawings, like numerals refer to like elements.

DETAILED DESCRIPTION OF THE INVENTION

In the description of the preferred embodiments set out below, it will be recognized by those skilled in the art that various alternative materials and structures which are not specifically disclosed are also within the scope of this invention. For purposes of illustration and discussion, each bag panel or ply will be shown as a single heat-sealable laminate. In actual practice, each bag panel will likely be a laminate of two or more layers which will provide sufficient protection to the product (e.g., oxygen and moisture barriers) and which can form a peelable, hermetic heat seal and possibly even a non-peelable, hermetic heat seal at their inner surfaces. As is known to the art, a surface of "Saran", a vinylidene chloride-vinyl chloride copolymer, in contact with a surface of ethylene vinyl acetate can form such peelable bonds. The peel seal should have an opening force of from 1.5 to 6.0 pounds, as discussed in the Hustad and Griesbach patent.

The reclosure seal can be comprised of interlocking closure strips which are adhesively bonded or heat sealed to the inner face of each bag panel. Alternatively, the reclosure elements can be formed during the film extrusion process.

Elements which constitute the tamper-evident feature will preferably be integral with the bag panels prior to the formation of the bag. Where necessary, such as in the formation of certain heat seals, elements of the tamper-evident feature will be added or formed after the bag structure, including the peelable inner seal and the intermediate reclosure seal, has been produced.

Figure 1:
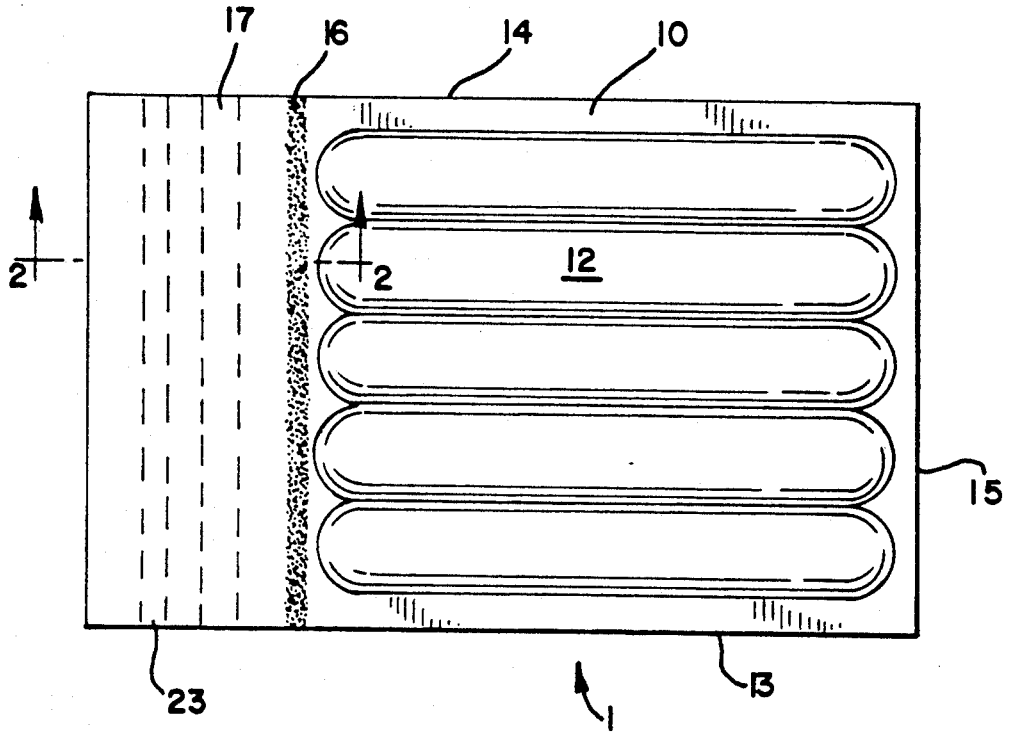
FIG. 1 is a plan view illustrating one embodiment of a tamper-evident, reclosable, hermetically-sealed package in accordance with this invention. For purposes of illustration, only the package is shown as containing vacuum-packed weiners.
Figure 2:
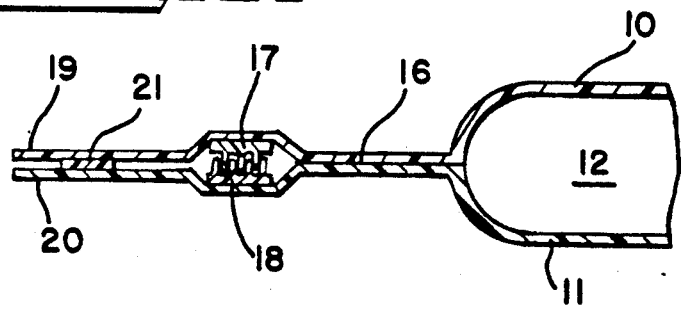
FIG. 2 is an enlarged, fragmentary, cross-sectional, elevational view taken along the line 2—2 of FIG. 1.

FIGS. 1 and 2 illustrate a package 1 formed of top and bottom bag panels 10 and 11 which enclose a plurality of weiner or weiner-shaped products 12. The weiners 12 are vacuumed-packed so that the bag panels are in intimate contact with the surface of the weiners. Bag panels 10 and 11 are sealed along side edges 13 and 14 by means of continuous heat seals. The bottom edge 15 of the bag may be an additional heat seal, or alternatively, the bottom edge may be a fold which forms a continuous sheet into opposed panels 10 and 11. A hermetic, peel seal extends across the width of the package at 16, the seal being formed by adherent contact between films 10 and 11 as a result of known heat-sealing equipment and techniques.

The same heat may be applied to side seals 13 and 14 and bottom seal 15 as is applied to seal area 16 such that all of these seals are equally peelable. The structure of the bag would, however, essentially preclude opening of seals 13, 14 and 15 during normal use. Alternatively, seals 13, 14 and 15 can be formed as non-peelable seals such as by supplying more heat to form these seals than to form seal area 16 or by applying a coating at seal area 16 to prevent formation of a permanent, non-peelable seal.

Interlocking reclosure strips 17 and 18 are bonded to bag panels 10 and 11 at a location which is parallel to and spaced apart from the seal area 16. As shown, reclosure strips 17 and 18 are also recessed in the mouth of the package 1, away from the top edges of the bag.

Positioned between the lips (19 and 20) of the bag is a tamper-evident feature 21 which is bonded to the inner face of lips 19 and 20. According to this embodiment, tamper-evident feature 21 is a tear element, such as a paper or plastic-tape, a strip of adhesive material which will form a one-time bond (i.e. if opened, will not adhere again), or a peel seal. The tear element will extend across the width of bag but need not be continuous and need not be in the form of a straight line. A preferred embodiment of tear element is a paper tape which will pull apart when lips 19 and 20 are separated. The tear element must be capable of showing visible signs of separation, and fiber tear of a paper tape is merely one such sign. Other signs, such as color changes or stress marks, are equally acceptable.

Figure 3:
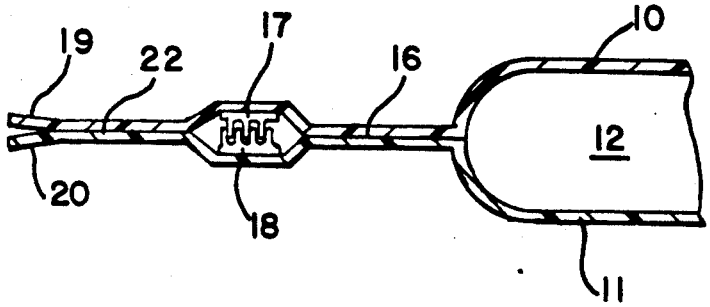
FIGS. 3 and 4 are views like FIG. 2, showing modifications thereof.

FIG. 3 depicts an embodiment, comparable to FIG. 2, wherein tamper-evident feature is a peelable seal 22 which is comparable to peelable seal 16. Seal 22 can be made at the same time and using equipment and techniques which are duplicative of the manner in which peel seal 16 is produced. Peel seal 22 could be either hermetic or non-hermetic. It will further be desirable to form peel seal 22 in such a manner that when the seal is broken at least one of film surfaces undergoes a change in appearance, such as by changing from transparent to opaque, smokey, or translucent.

Figure 4:
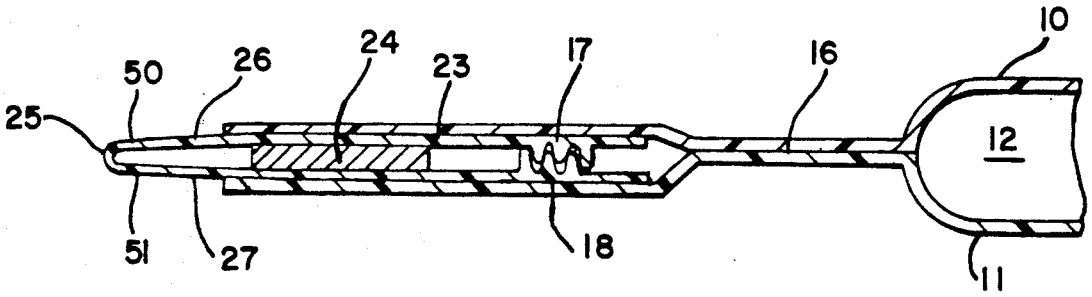

FIG. 4 depicts an embodiment wherein an extruded zipper strip 23 which contain interlocking zipper elements 17 and 18 positioned at opposite end thereof is folded upon itself and secured to the ends of bag panels 10 and 11. As shown in the figure, the tamper-evident feature 24 is a paper tape adhesively bonded to both inner faces of the zipper strip 23. Preferably, the closed-end or nose portion 25 of the folded zipper strip is removed at the time of manufacture in order to present lips 26 and 27 for grasping by the consumer. Alternatively, the nose portion 25 may be perforated at 50 and 51 for removal of portion 25 by the consumer.

Figure 5:
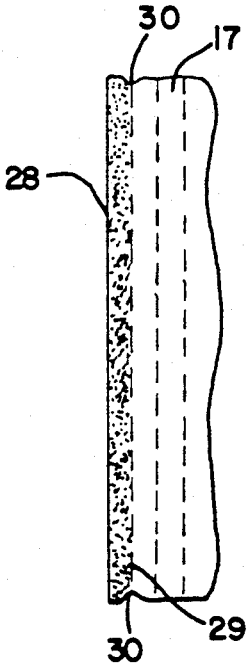
FIGS. 5 to 8 are plan views of other embodiments of a tamper-evident, reclosable, hermetically-sealed package in accordance with the invention. These figures depict only that portion of the package above the peel seal, the remainder of the bag being as shown in FIG. 1.

FIG. 5 depicts a package according to the invention wherein the tamper-evident feature is a heat seal 28 which extends across the width of the package and is peripheral to or outside of the reclosure seal. Heat seal 28, which as shown is parallel to the reclosure seal and located at the top edge of the package, is bounded at its lower edge by a line of perforations 29 which extends through both upper and lower bag panels. In this manner, the heat seal functions as a tear strip which has to be removed to gain access to the reclosure seal. Heat seal 28 imparts a degree of rigidity to the bag material which makes the strip easy to grasp and tear away. Either or both ends of the line of perforations 29 may be notched, such as at 30, so as to facilitate initial tearing of heat seal 28. The line of perforations 29 should be spaced-apart from reclosure strip 17 by a sufficient distance that after removal of the heat sealed tear strip a sufficient amount of film material remains to permit the consumer to grasp the films and separate reclosure seal 17. Of course, heat seal 28 does not have to extend to the top edge of the bag panels.

Figure 6:
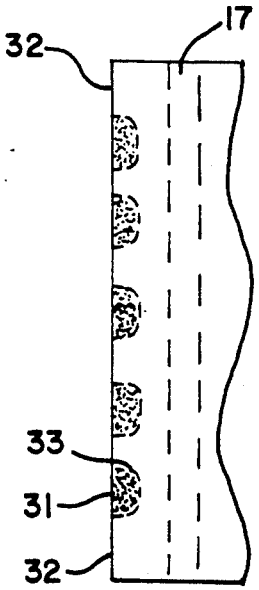

FIG. 6 depicts a modification of FIG. 5 wherein the heat seal is intermittent across the top the package. The intermittent heat seals 31 are spaced-inwardly from at least one edge of the package in order to provide an opening 32 for the consumer to insert a finger and then pull up through the outermost heat seal. This procedure would be repeated for subsequent spaced-apart heat seals. According to one embodiment, the heat seals 31 are peelable seals which are merely broken by the action of the consumer's finger. According to the embodiment shown in FIG. 6, heat seals 31 are non-peelable and lines of perforations 33 encompass each intermittent heat seal 31. Perforated lines 33 would permit neat and efficient removal of the heat-sealed areas 31. Heat seals 31 may be shaped in various forms, such as the hemispherical spot seals shown in the FIG. 6 or rectangular bar seals.

Figure 7:
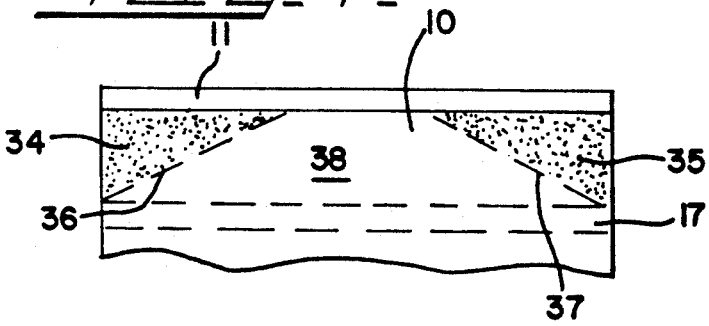

FIG. 7 illustrates an embodiment wherein heat sealed areas 34 and 35 are formed between the bag panels 10 and 11 above or peripheral to the reclosure seal. Heat seals 34 and 35 extend from the side edges of the bag and are bounded by lines of perforations 36 and 37 which are contained on top bag panel 10 and not on panel 11. A top portion of bag panel 10, shown at 38, is unsealed and forms a tearable flap which may be separated from heat sealed areas 34 and 35, along lines 36 and 37, in order to provide easy access to the reclosure seal. Lines of perforation 36 and 37 extend in an angled or curved fashion from the ends of the reclosure seal to the top edge of bag panel 10; this will permit full access to the reclosure seal. As shown in FIG. 7, bag panel 11 extends slightly beyond the top edge of bag panel 10 in order to facilitate grasping the top, unsealed edge of tearable flap 38. Flap 38 may be removable from the package by including another line of perforations in bag panel 11 which is parallel to and slightly above the reclosure seal.

As shown in FIG. 7, heat seals 34 and 35 would be non-peelable. It would, of course, be possible to have heat seals 34 and 35 as peelable, in which event lines of perforation 36 and 37 would not be necessary.

Figure 8:
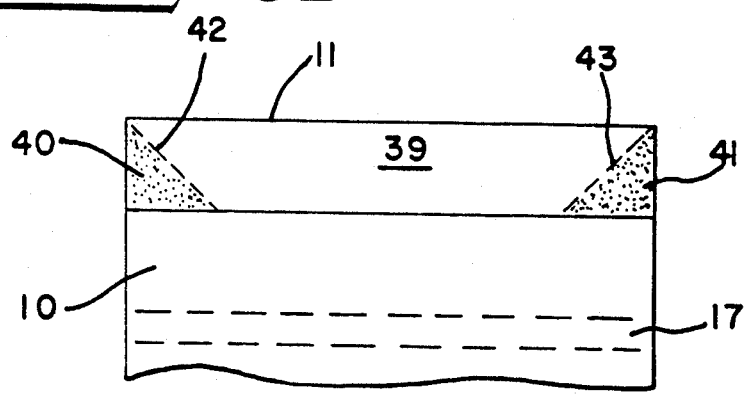

FIG. 8 shows an embodiment of this invention wherein bottom bag panel 11 extends beyond top edge bag panel 10 by a sufficient length to form a flap 39 which is folded down onto panel 10. Flap 39 is adhered to the upper surface of panel 10 at areas 40 and 41 which extend from the side edges of flap 39 and are bordered by lines of perforations 42 and 43. These lines of perforations extend from the free end of flap 39, at a point which is spaced-away from the side edges of the flap, to the top corners of the package. According to this embodiment, flap 39 must be torn from adhered areas 40 and 41, along lines of perforations 42 and 43, and folded back in order to gain access to the top edge of bag panel 10 and the reclosable seal and the peel seal contained in the mouth of the package.

The bonding which occurs at 40 and 41 may be by means of an adhesive or by heat sealing. If heat sealing is employed, care must be taken so as not to bond the inner surfaces of bag panels 10 and 11. Such means as temperature control, release coatings, release sheets and the like may be utilized to selectively prevent bonding of these inner surfaces. The seals formed at areas 40 and 41 could, of course, be either non-peelable or peelable. In the event peelable seals were formed, lines of perforation 42 and 43 would not be necessary and sealed areas 40 and 41 could assume a wider variety of shapes.

While various embodiments of packages illustrating this invention have been described, it will be apparent that certain modifications and variations therefrom may be made without departing from the spirit and scope of this invention. Accordingly, only such limitations are to be imposed thereon as are indicated in the appended claims.

Having thus described the invention, what is claimed is:

1. In a reclosable, flexible package wherein a product is hermetically sealed between opposed wall panels, wherein the package is permanently sealed about its bottom and side periphery and is sealed with a hermetic peel seal adjacent to the product towards the top of the package and wherein the package has a reclosure seal comprised of interlocking closure strips and located adjacent and peripheral to the hermetic peel seal and below the top edges of the package, the improvement comprising a tamper-evident feature located above the reclosure seal of the package wherein visible disruption of the tamper-evident feature is necessary in order to gain access to the reclosure seal and wherein the tamper-evident feature can be fully disrupted by digital forces wherein the opposed wall panels are sealed in face-to-face relationship with intermittent spot seals which generally extend the width of the package, which spot seals are located above the reclosure seal, and each intermittent spot seal is bordered by a line of perforations.

2. The package of claim 1 wherein the face-to-face intermittent spot seals are heat seals.

3. The package of claim 2, wherein the heat seals includes intermittent portions of the opposed wall panels.

4. The package of claim 1 wherein the intermittent spot seals are heat seals, which seals are adapted to be torn by means of digital forces.

5. The package of claim 4 wherein the heat seals are seals which are spaced across the top edge of the package.

6. The package of claim 1 wherein the intermittent seals are peelable seals.

* * * * *

UNITED STATES PATENT AND TRADEMARK OFFICE

CERTIFICATE OF CORRECTION

PATENT NO. : 5,224,779

DATED : July 6, 1993

INVENTOR(S) : Bjorn J. Thompson, Gerald O. Hustad and Todd S. Marnocha

It is certified that error appears in the above-indentified patent and that said Letters Patent is hereby corrected as shown below:

Col. 1, line 44, "previously-opened" should read --previously opened--.
Col. 2, line 3, "seal and" should read --seal, and--; line 13, "vacuum, a" should read --vacuum or a--; line 19, "surface of" should read --surfaces of--.
Col. 3, line 64, "wherein tamper-evident" should read --wherein the tamper-evident--.
Col. 4, line 3, "of film" should read --of the film--; line 33, "spaced-apart" should read --spaced apart--; line 40, "top the" should read --top of the--; line 41, " spaced-inwardly" should read --spaced inwardly--.
Col. 5, line 20, "spaced-away" should read --spaced away--.
Col. 6, line 30, "includes" should read --include--.

Signed and Sealed this

Twenty-ninth Day of November, 1994

*Attest:*

Bruce Lehman

BRUCE LEHMAN

*Attesting Officer*

*Commissioner of Patents and Trademarks*